US009103562B2

(12) United States Patent
Nakagawa et al.

(10) Patent No.: US 9,103,562 B2
(45) **Date of Patent: *Aug. 11, 2015**

(54) FIXED (AND SELECTIVELY FIXED) BYPASS PUMPLESS COMBINATION INSTANTANEOUS/STORAGE WATER HEATER SYSTEM

(71) Applicants: Daichi L Nakagawa, Garden Grove, CA (US); Kevin J Pirotin, Irvine, CA (US)

(72) Inventors: Daichi L Nakagawa, Garden Grove, CA (US); Kevin J Pirotin, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/284,284

(22) Filed: May 21, 2014

(65) Prior Publication Data

US 2014/0363147 A1 Dec. 11, 2014

Related U.S. Application Data

(63) Continuation of application No. 13/475,999, filed on May 20, 2012, now Pat. No. 8,768,154.

(51) Int. Cl.

| | |
|---|---|
| ***H05B 3/78*** | (2006.01) |
| ***F24H 1/22*** | (2006.01) |
| ***F24H 1/12*** | (2006.01) |
| ***F24H 9/20*** | (2006.01) |

(52) U.S. Cl.

CPC ..... *F24H 1/22* (2013.01); *F24H 1/122* (2013.01); *F24H 9/2021* (2013.01); *F24H 9/2028* (2013.01); *Y10T 137/6443* (2015.04); *Y10T 137/6497* (2015.04); *Y10T 137/6606* (2015.04)

(58) Field of Classification Search

None

See application file for complete search history.

(56) References Cited

U.S. PATENT DOCUMENTS

| | | | | | |
|---|---|---|---|---|---|
| 1,913,622 | A * | 6/1933 | Williams | 137/102 |
| 3,249,303 | A * | 5/1966 | Townsend | 237/8 R |
| 3,575,157 | A * | 4/1971 | Whittel, Jr. | 122/14.2 |
| 4,155,506 | A * | 5/1979 | Brosenius | 237/81 |
| 4,175,698 | A * | 11/1979 | Brosenius | 237/19 |
| 4,977,885 | A * | 12/1990 | Herweyer et al. | 122/14.31 |
| 5,588,088 | A * | 12/1996 | Flaman | 392/449 |
| 6,024,290 | A * | 2/2000 | Dosani et al. | 236/12.12 |
| 6,861,621 | B2 * | 3/2005 | Ghent | 219/492 |
| 7,020,387 | B1 * | 3/2006 | Andrakin | 392/465 |
| 7,298,968 | B1 * | 11/2007 | Boros et al. | 392/494 |
| 7,460,769 | B2 * | 12/2008 | Ryks | 392/490 |
| 8,366,014 | B2 * | 2/2013 | Ene et al. | 237/19 |
| 8,437,626 | B2 * | 5/2013 | Ding et al. | 392/308 |
| 8,768,154 | B2 * | 7/2014 | Nakagawa et al. | 392/485 |
| 2002/0146241 | A1 * | 10/2002 | Murahashi et al. | 392/308 |
| 2004/0041034 | A1 * | 3/2004 | Kemp | 236/12.12 |
| 2012/0024968 | A1 * | 2/2012 | Beyerle et al. | 236/12.11 |

* cited by examiner

*Primary Examiner* — Thor Campbell

(57) ABSTRACT

A representatively pumpless water heater system has an instantaneous water heater coupled in series with a storage water heater by piping circuitry incorporating a fixed (and selectively fixed) bypass useable to route pressurized incoming cold water sequentially through the instantaneous and storage type heaters. The fixed bypass can also route pressurized incoming cold water to mix with the heated water exiting the instantaneous heater for delivery to the storage heater.

4 Claims, 5 Drawing Sheets

FIXED (AND SELECTIVELY FIXED) BYPASS PUMPLESS COMBINATION INSTANTANEOUS/STORAGE WATER HEATER SYSTEM

PRIORITY CLAIM

This patent application is a continuation patent application of U.S. patent application Ser. No. 13/475,999, titled "FIXED (AND SELECTIVELY FIXED) BYPASS PUMPLESS COMBINATION INSTANTANEOUS/STORAGE WATER HEATER SYSTEM," filed May 20, 2012, which claims priority to U.S. Provisional Patent Application No. 61/499,185, titled "FIXED (AND SELECTIVELY FIXED) BYPASS PUMPLESS COMBINATION INSTANTANEOUS/STORAGE WATER HEATER SYSTEM," filed Jun. 21, 2011.

BACKGROUND OF THE INVENTION

The present invention generally relates to liquid heating apparatus and, in representatively illustrated embodiments thereof, more particularly provides a specially designed, pumpless combination instantaneous/storage water heater system.

The on-demand supply of hot water to plumbing fixtures such as sinks, dishwashers, bathtubs and the like has for years been achieved using fuel-fired or electric water heaters in which a relatively large water storage tank is provided with a fuel-fired burner or one or more electric heating elements controlled to maintain pressurized, tank-stored water at a selectively variable delivery temperature—typically around 120 degrees Fahrenheit. Pressurized cold water from a source is piped to the tank to replenish hot water drawn for supply to one or more plumbing fixtures operatively connected to the water heater.

Another conventional way of providing an on-demand supply of hot water to various plumbing fixtures is to use a tankless or "instantaneous" water heater in which water is flowed through a high heat input heat exchanger, without appreciable water storage capacity, so as to provide only as much hot water as needed by the open fixture(s). Where higher hot water flow rates than the instantaneous water heater can provide at the desired heated temperature are required, it has been conventional practice to connect a storage tank to the instantaneous water heater, in series, to augment the hot water delivery capability of the instantaneous water heater with pre-heated storage tank water.

According to another conventional practice, a hot water recirculating loop with a circulating pump therein is operatively coupled to one or both of the instantaneous heater and storage tank to provide even faster delivery of hot water to the served fixtures. Despite the overall hot water production and delivery improvements provided by these conventional instantaneous/tank type water heater combinations, they present several well-known problems, limitations and disadvantages.

For example, the necessity of providing a pump and the pump's necessary controls undesirably builds in additional cost and complexity to the overall hot water supply system.

It would thus be desirable to provide an improved combination instantaneous/tank type water heater system in which the attendant complexity and cost, of pumps, mixing valves and controls was eliminated or minimized.

SUMMARY OF THE INVENTION

In carrying out principles of the present invention, in accordance with representatively illustrated embodiments thereof, specially designed, representatively pumpless fluid heating apparatus is provided which comprises an instantaneous fluid heater, a fluid storage vessel, and flow circuitry, interconnected between the instantaneous fluid heater and the fluid storage vessel. Via the flow circuitry an incoming fluid may be sequentially flowed through the instantaneous fluid heater and the fluid storage vessel or through a fixed (or selectively fixed) bypass to mix with the heated water exiting the instantaneous heater for delivery to the storage heater for discharge from the apparatus as heated fluid.

The flow circuitry, which is representatively piping interconnecting the instantaneous fluid heater in series with the fluid storage vessel, has incorporated therein (1) an incoming fluid bypass structure, representatively a bypass pipe, operable to cause a fixed portion of the incoming fluid to bypass the instantaneous fluid heater, and (2) an orifice connected in series with said incoming fluid bypass pipe and operable to blend a fixed amount of the bypassed fluid and heated fluid exiting said instantaneous fluid heater to maximize the temperature of heated fluid entering the fluid storage vessel while minimizing the pressure loss through the entire system.

The flow circuitry may incorporate therein instead of the orifice, a mixing valve, operable to receive heated fluid exiting the instantaneous fluid heater and unheated fluid through the bypass pipe to deliver to the fluid storage vessel at a fixed temperature.

The flow circuitry may further incorporate therein instead of the orifice, a solenoid valve, operable to control whether unheated fluid will pass through the bypass pipe and mix with the water exiting the instantaneous fluid heater before entering the fluid storage vessel. The opening and closing of said solenoid valve can be controlled by (1) a thermostatically controlled electrical switching device placed in a position to measure the temperature of the fluid entering the fluid storage vessel, (2) an electrical relay triggered by the signal of a flow sensor or flow switch that is internal to the instantaneous fluid heater, or (3) a flow switch in line previous to the bypass pipe.

Illustratively, the fluid heating apparatus is a water heating apparatus, with the instantaneous fluid heater being a fuel-fired instantaneous type water heater, and the fluid storage vessel being the water storage vessel being the tank portion of a storage type water heater having an electrical heating section used to selectively add heat to water disposed within the tank. However, the system described herein is not limited to water heater heating and may be advantageously employed with a variety of other types of fluids to be heated.

Preferably, the combination instantaneous/storage type fluid heating apparatus of the present invention is of a pumpless construction. However, if desired, a pumped fluid recirculation system could be suitably incorporated into the apparatus without departing from principles of the present invention.

DETAILED DESCRIPTION

Figure 1:
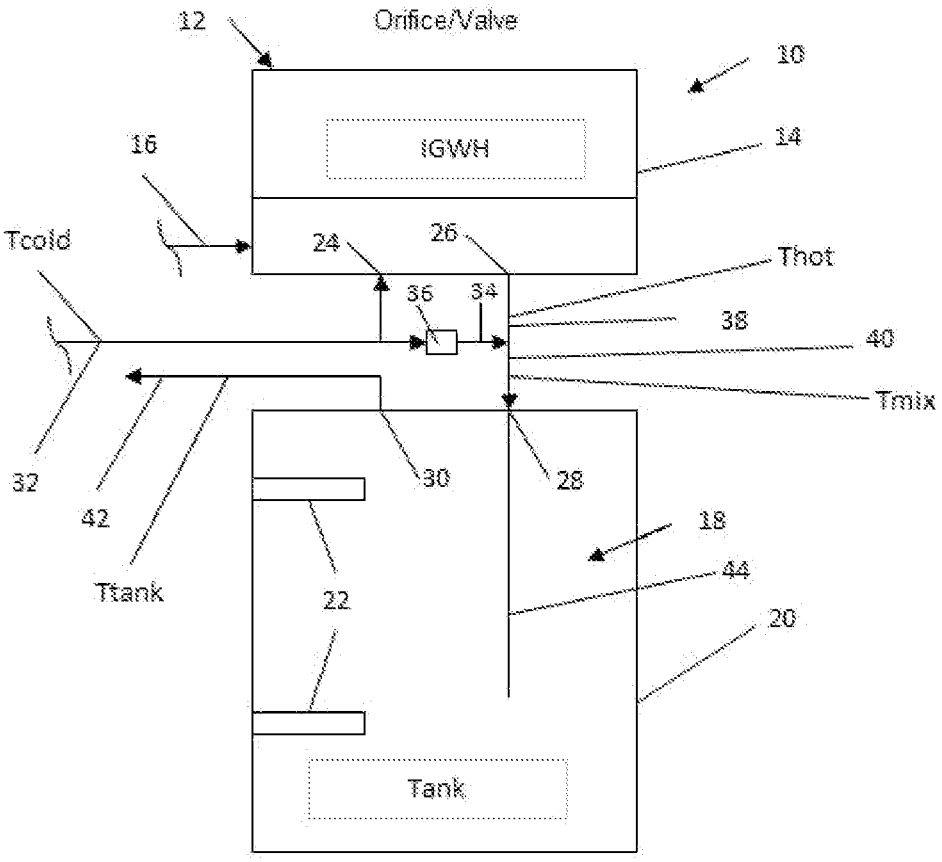
FIG. 1 is a schematic diagram of a specially designed pumpless, combination instantaneous/storage water heating system embodying principles of the present invention.

Schematically depicted in FIG. 1 is a pumpless water heater heating system 10 that embodies principles of the present invention and includes an instantaneous gas water heater (IGWH) 12 having a burner section 14 supplied with gaseous fuel via a gas supply line 16, and a storage type water heater (SWH) 18 having a water storage tank 20 with electric heating elements 22 extending into the interior of tank 20. IGWH 12 has a water inlet 24, and a water outlet 26, and tank 20 has a water inlet 28 and a water outlet 30.

A water line 34 is interconnected between the IGWH inlet 24 and the tank inlet 28, and a water line 38 is interconnected between the IGWH outlet 26 and the tank inlet 28 and extends from the tank inlet 28 downwardly through the interior of the tank 20 to a bottom portion thereof. Valve 36 is operatively connected as shown in the water line 34. Valve 36 is a bypass valve controllable to allow a selectively variable flow or an orifice to allow a fixed amount of incoming cold water therethrough via the line 34 in the direction of the arrows in line 34. A cold water inlet line 32 (through which incoming cold water is flowed to the system) is connected as shown in the line 34 between the IGWH inlet 24 and the valve 36 as shown.

During a demand for hot water supply from the system 10, pressurized hot water at temperature $T_{TANK}$ is discharged from the tank outlet 30 to the open fixture(s) served by line 42 while at the same time pressurized cold water, at temperature $T_{COLD}$, from a source, is flowed through line 32 into the segment of the line 34 between the IGWH outlet 26 and the bypass valve 36. A portion of this incoming pressurized cold water is flowed into the through IGWH 12 and discharged therefrom, into the line 38, as heated water, at temperature $T_{HOT}$. The balance of the incoming pressurized cold water bypasses IGWH 12 and flows through the valve 36 into the line 34 where it mixes with line 38 to become $T_{MIX}$, which flows into the interior of the tank 20 via line 40.

As needed (for example during standby periods of the system 10), the electric heating elements 22 may be energized to maintain $T_{TANK}$ at an appropriate level.

It is important to note that the unique use of the cold water bypass valve 36 in the overall interconnecting flow circuitry of the system 10 advantageously permits full flow from tank 20 while allowing a constant volume of $T_{MIX}$ into the tank inlet 28.

The selective bypassing of cold inlet water around IGWH 12 helps reduce pressure loss and limited flow in the heat exchanger portion of IGWH 12. The bypass ratio of valve 36 may be fixed or adjustable with respect to the outlet temperature $T_{HOT}$.

As previously mentioned herein, system 10 efficiently functions without the expense of a pump and its associated recirculation piping (although such a pump and associated recirculation piping could be appropriately added to the system if desired). Instead, the "driving" force selectively flowing the tempered water to the plumbing fixture(s) via pipe 42 is simply the pressure of the cold water source coupled to the pipe 40. Additionally, the combination system 10 is provided with improved hot water supply from Tank 18 due to the provision of the cold water bypass valve 36 in the piping circuitry interconnecting IGWH 12 and SWH 18.

Figure 2:
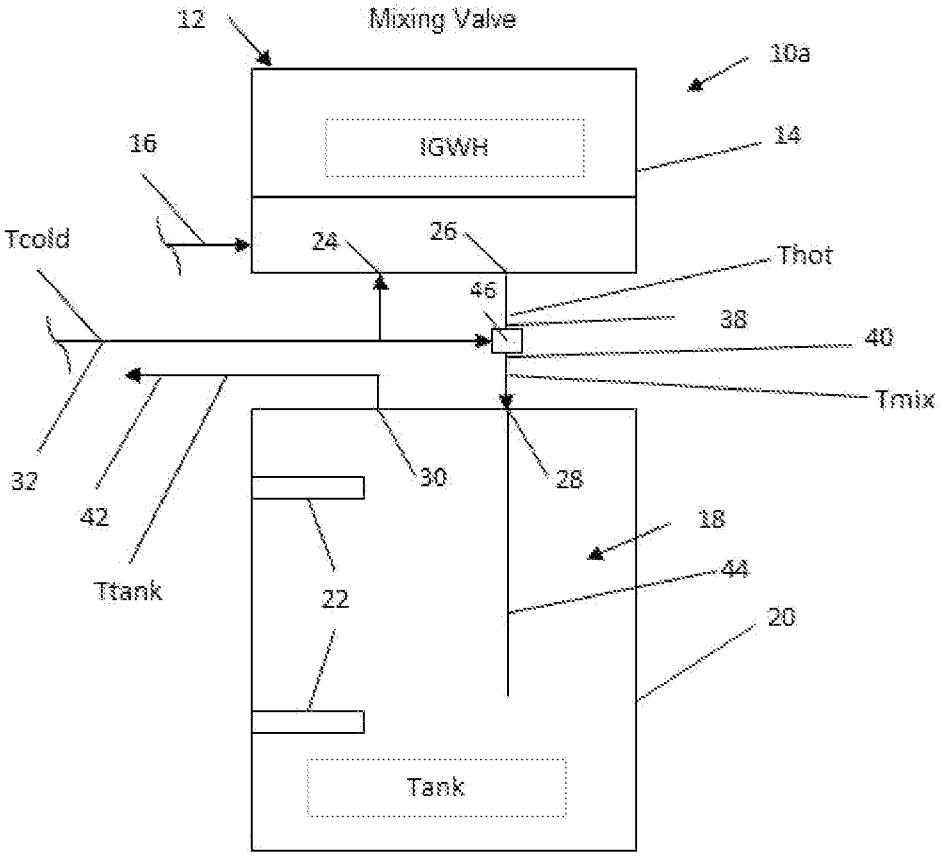
FIG. 2 is a schematic diagram of an alternate embodiment of the FIG. 1 system.

An alternate embodiment 10*a* of the previously described pumpless water heating system 10 is schematically depicted in FIG. 2. System 10*a* is identical to system 10 with the exceptions that (1) valve 36 is replaced with a mixing valve, representatively a thermostatically controlled mixing valve 46. The mixing valve 46 allows cold water from line 32 to bypass IGWH 12 and mix with $T_{MIX}$ from line 38 and flow into tank 20 as $T_{MIX}$ through line 40. This feature provides for substantially improved temperature control of $T_{MIX}$ by providing a controlled mix of $T_{COLD}$ from line 32 and $T_{HOT}$ discharged from IGWH 12.

Figure 3:
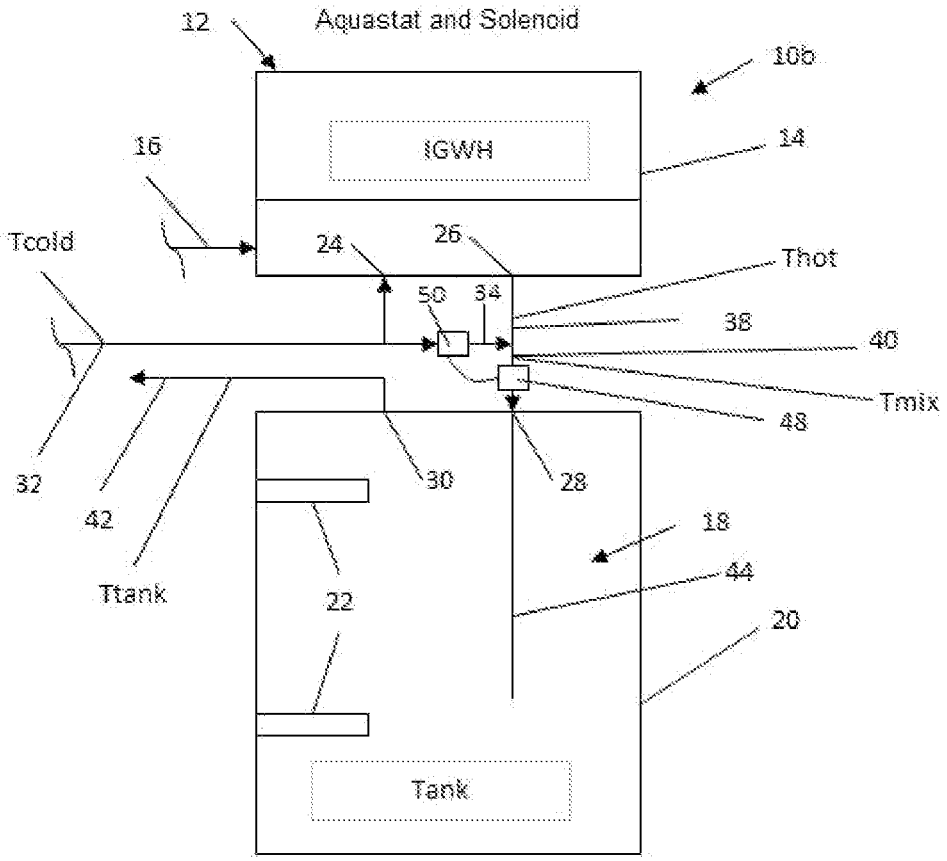
FIG. 3 is a schematic diagram of an alternate embodiment of the FIG. 1 system.

An alternate embodiment 10*b* of the previously described pumpless water heating system 10 is schematically depicted in FIG. 3. System 10*b* is identical to system 10 with the exceptions that valve 36 is replaced with a thermal switch (ie "Aquastat) 48 and a normally closed solenoid valve 50. The thermal switch 48 allows cold water from line 32 to bypass IGWH 12 and mix with $T_{HOT}$ from line 38 and flow into tank 20 as $T_{MIX}$ through line 40.

This feature allows for better utilization of the IGWH 12 during low usage (flow) periods by eliminating unnecessary amounts of $T_{COLD}$ into tank 20. During high usage (flow) periods, $T_{HOT}$ from IGWH 12 will decrease below the set temperature of thermal switch 48 thus activating solenoid 50 to provide a greater volume of $T_{MIX}$ into tank 20.

Figure 4:
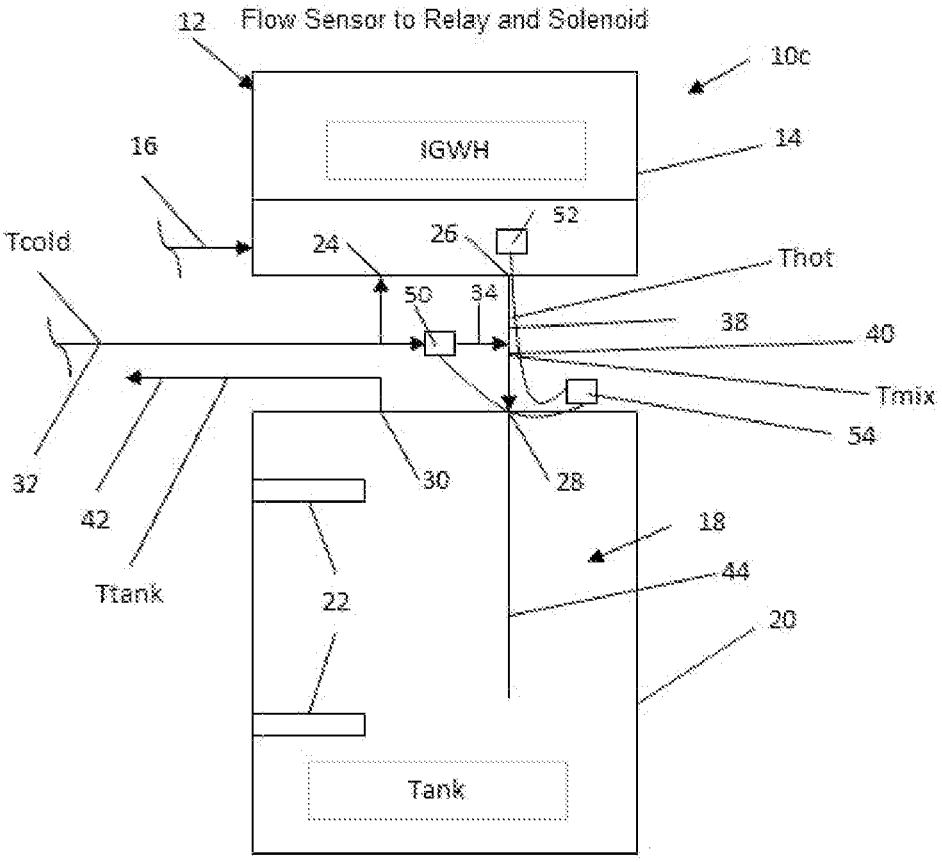
FIG. 4 is a schematic diagram of an alternate embodiment of the FIG. 1 system.

An alternate embodiment 10*c* of the previously described pumpless water heating system 10 is schematically depicted in FIG. 4. System 10*c* is identical to system 10*b* with the exceptions that thermal switch 48 is replaced with a flow sensor 52 and a relay 54. The flow sensor 52 sends a signal to relay 54 when a predetermined amount of flow is passing through IGWH 12 to activate solenoid valve 50. Flow sensor 52 can be integral to IGWH 12 or installed in lines 32, 38, or 40. This feature allows for an alternate means to detect heavy usage (flow) periods based on flow conditions rather than temperature conditions. As previously mentioned in alternate embodiment 10*b*, solenoid 50 will only activate during high usage (flow) periods in order to make best utilization of IGWH 12.

Figure 5:
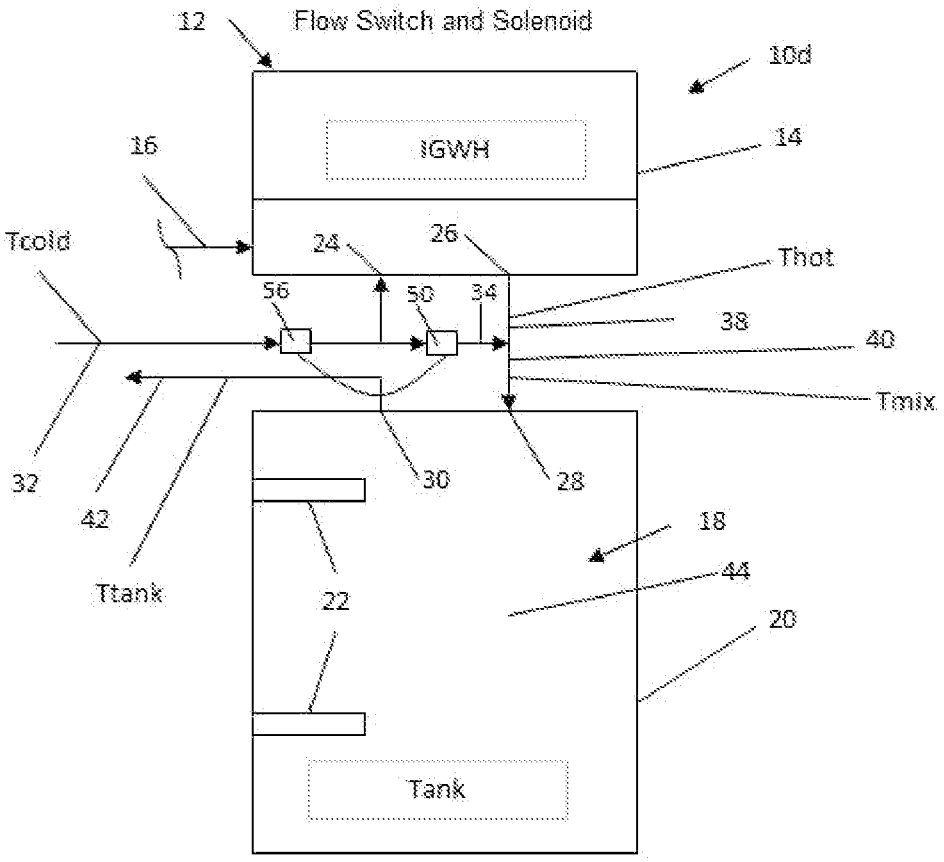
FIG. 5 is a schematic diagram of an alternate embodiment of the FIG. 1 system.

An alternate embodiment 10*d* of the previously described pumpless water heating system 10 is schematically depicted in FIG. 5. System 10*c* is identical to system 10*b* with the exceptions that thermal switch 48 is replaced with flow switch 56. The flow switch 56 sends a signal to solenoid valve 50 when a predetermined amount of flow is passing through line 32. This feature allows for a direct signal to solenoid 50 without the use of additional electronics as describe in alternate embodiment 10*c*. As previously mentioned in alternate embodiment 10*b*, solenoid 50 will only activate during high usage (flow) periods in order to make best utilization of IGWH 12.

In any of alternate embodiments 10*a*,10*b*,10*c* and 10*d*, valve 36 as shown in FIG. 1 could be added to line 32 to provide a fixed amount of the incoming fluid to bypass IGWH 12. As can be readily seen from the foregoing, the representatively illustrated embodiments 10,10*a*,10*b*,10*c*,10*d* of the pumpless water heater system of the present invention, compared to conventional combination instantaneous/tank type water heater systems, provide improved water temperature and flow rate control, while at the same time eliminating the complexity and cost of an associated mechanical pumping system.

While the pumpless systems 10,10*a*,10*b*,10*c*,10*d* illustrated and described herein are representatively water heating systems, principles of the present invention are not limited to water heating but could be alternatively employed to advantage in conjunction with supply systems for other types of fluids. Additionally, while as previously mentioned herein the systems 10,10*a*,10*b*,10*c*,10*d* are representatively of pumpless configurations, various types of pumps and associated recirculation systems could be appropriately incorporated therein if desired.

In yet a further alternative embodiment, the flow circuitry described herein may be disposed within a self-contained unit that can be operably integrated such that an instantaneous fluid heater could be connected to any fluid storage vessel.

The foregoing detailed description is to be clearly understood as being given by way of illustration and example only, the spirit and scope of the present invention being limited solely by the appended claims.

What is claimed is:

1. Fluid heating apparatus comprising:

an instantaneous fluid heater;

a fluid storage vessel;

a heating structure selectively operable to add auxiliary heat to fluid in said fluid storage vessel; and flow circuitry, interconnected between said instantaneous fluid heater and said fluid storage vessel, via which an incoming fluid may be sequentially flowed through said instantaneous fluid heater and said fluid storage vessel for discharge from said apparatus as heated fluid, said flow circuitry including (1) an incoming fluid bypass pipe operable to cause a fixed portion of non-heated incoming fluid to bypass said instantaneous fluid heater, and (2) a solenoid valve connected in series with said incoming fluid bypass pipe and operable to control a blend of a selectively fixed amount of non-heated bypassed fluid and heated fluid exiting said instantaneous fluid heater which enters the fluid storage vessel to maximize the temperature of fluid entering the fluid storage vessel while minimizing the pressure loss through the entire system; and (3) a flow switch connect in line before the bypass pipe which controls the opening and closing of said solenoid valve based on the amount of fluid entering the entire system.

2. The fluid heating apparatus of claim 1 wherein said instantaneous fluid heater is fuel-fired.

3. The fluid heating apparatus of claim 1 wherein said heating structure is an electrical heating structure.

4. The fluid heating apparatus of claim 1 wherein said fluid heating apparatus is of a pumpless construction.

* * * * *